US006814538B2

(12) United States Patent
Thompson

(10) Patent No.: US 6,814,538 B2
(45) Date of Patent: Nov. 9, 2004

(54) TURBINE STAGE ONE SHROUD CONFIGURATION AND METHOD FOR SERVICE ENHANCEMENT

(75) Inventor: Jeff Thompson, Jackson, TN (US)

(73) Assignee: General Electric Company, Schenectady, NY (US)

( * ) Notice: Subject to any disclaimer, the term of this patent is extended or adjusted under 35 U.S.C. 154(b) by 18 days.

(21) Appl. No.: 10/348,010

(22) Filed: Jan. 22, 2003

(65) Prior Publication Data

US 2004/0141838 A1 Jul. 22, 2004

(51) Int. Cl.[7] ..... F01D 11/08

(52) U.S. Cl. ..... 415/116; 415/139; 415/173.1; 29/889.1; 29/889.22

(58) Field of Search ..... 415/115, 116, 415/138, 139, 173.1–173.5; 24/889.1, 889.22

(56) References Cited

U.S. PATENT DOCUMENTS

| | | | | |
|---|---|---|---|---|
| 4,050,843 A | | 9/1977 | Needham et al. | |
| 4,177,004 A | * | 12/1979 | Riedmiller et al. | 415/116 |
| 4,551,064 A | | 11/1985 | Pask | |
| 4,573,866 A | | 3/1986 | Sandy et al. | |
| 4,752,184 A | | 6/1988 | Liang | |
| 5,022,816 A | | 6/1991 | Maier et al. | |
| 5,127,793 A | | 7/1992 | Walker et al. | |
| 5,165,847 A | | 11/1992 | Proctor et al. | |
| 5,167,485 A | | 12/1992 | Starkweather | |
| 5,169,287 A | | 12/1992 | Proctor et al. | |
| 5,197,853 A | | 3/1993 | Creevy et al. | |
| 5,211,534 A | | 5/1993 | Catlow | |
| 5,328,328 A | | 7/1994 | Charbonnel et al. | |
| 5,333,992 A | | 8/1994 | Kane et al. | |
| 5,423,659 A | | 6/1995 | Thompson | |
| 5,609,469 A | | 3/1997 | Worley et al. | |
| 5,993,150 A | * | 11/1999 | Liotta et al. | 415/115 |
| 6,113,349 A | | 9/2000 | Bagepalli et al. | |
| 6,116,852 A | * | 9/2000 | Pierre et al. | 415/115 |
| 6,126,389 A | * | 10/2000 | Burdgick | 415/115 |
| 6,315,519 B1 | | 11/2001 | Bagepalli et al. | |
| 6,340,285 B1 | * | 1/2002 | Gonyou et al. | 415/116 |
| 6,402,466 B1 | | 6/2002 | Burdgick et al. | |

* cited by examiner

*Primary Examiner*—Christopher Verdier
(74) *Attorney, Agent, or Firm*—Nixon & Vanderhye PC

(57) ABSTRACT

A stator shroud segment is provided that includes an outer shroud having a leading edge groove and a trailing edge groove, both grooves of the outer shroud opening in a first, axial direction; and a plurality of inner shrouds each having a leading edge hook and a trailing edge hook. The hooks of the inner shrouds project in a second, axial direction, diametrically opposite the first axial direction and the leading and trailing hooks of each of the inner shrouds are respectively engaged with the leading and trailing edge grooves of the outer shroud so as to axially and radially lock the inner shrouds to the outer shroud. The assembly simplifies access to and removal of the inner shroud(s) without added complexity.

15 Claims, 4 Drawing Sheets

TURBINE STAGE ONE SHROUD CONFIGURATION AND METHOD FOR SERVICE ENHANCEMENT

BACKGROUND OF THE INVENTION

In an industrial gas turbine, shroud segments are fixed to turbine shell hooks in an annular array about the turbine rotor axis to form an annular shroud radially outwardly and adjacent the tips of buckets forming part of the turbine rotor. The inner wall of the shroud defines part of the gas path. Conventionally, the shroud segments are comprised of inner and outer shrouds provided with complimentary hooks and grooves adjacent their leading and trailing edges for joining the inner and outer shrouds to one another. The outer shroud is, in turn, secured to the turbine shell or casing hooks. In an exemplary configuration, each shroud segment has one outer shroud and two or three inner shrouds.

Two common approaches have been taken for the configuration of inner shrouds in the past; an opposite hook design and a C-clip design. The opposite hook design is the more traditional approach and incorporates oppositely projecting hooks on the leading and trailing edges that are retained by the outer shroud. The main service disadvantage with such an arrangement is that the inner shroud cannot be removed in the axial direction; it can only be slid out of the casing circumferentially. This access limitation requires any mating shroud assemblies to be removed before the shroud of interest can be accessed.

Thus, for the traditional opposite hook design, to remove a particular inner shroud, all preceding shrouds had to be removed by disengaging their anti-rotation pins and then sliding them out circumferentially, one-by-one, until the shroud of interest is accessible. For a 6C-engine part count of 66, this would require removing as many as 5 additional outer shrouds, along with 15 inner shrouds, before the inner shroud of interest is accessible.

The second conventional approach mentioned above, the C-clip design, provides a service enhancement to the opposite hook approach that allows axial access to the inner shroud. A conventional C-clip design is schematically illustrated in FIG. 1. As can be seen, like the traditional opposite hook approach, this arrangement also comprises leading and trailing edge hooks 10,12 projecting in opposite directions. However, the trailing edge hook 12 is retained with a separate C-clip 14, as opposed to being retained by the outer shroud 16. By removing the C-clip 14, the inner shroud 18 can be removed in the axial direction as shown by arrow A, thereby enhancing service access by allowing only the shroud 18 of interest to be removed. It should be noted, however, that at least one adjacent inner shroud, approximately one to three shrouds on each side (not shown), must still be shifted circumferentially to clear the cloth seals.

There are two main disadvantages of the above-described C-clip arrangement. The first is the added complexity of the additional C-clip components and features. These components and features include the C-clip itself, an anti-rotation pin, and the machined features required to accommodate axial and radial locating surfaces, a bearing surface for the C-clip, and the retention pin holes. A second disadvantage of the C-clip arrangement is that to allow service access to the C-clip pin, the stage two nozzles in the area of interest must be shifted circumferentially, which requires removal of the nozzle anti-rotation pins.

BRIEF DESCRIPTION OF THE INVENTION

Thus, further service enhancements, such as improved service access and reduced complexity, would be desirable.

The present invention proposes to modify the stage one inner shroud to reverse the leading edge hooks as compared to the traditional opposite hook design and C-clip design to allow for axial removal of the shroud of interest without removal of additional shrouds. Providing a reverse hook arrangement in accordance with an embodiment of the invention simplifies access without the added complexity of the C-clip design.

Thus the invention may be embodied in a stator shroud segment comprising: an outer shroud having a, leading, upstream edge and a trailing, downstream edge, and radially inner and radially outer faces, said outer shroud comprising a leading edge hook and a trailing edge hook, both said hooks of said outer shroud projecting in a first, axial direction; a plurality of inner shrouds each having a leading, upstream edge and a trailing, downstream edge, and radially inner and radially outer faces, said inner shroud comprising a leading edge hook and a trailing edge hook, both said hooks of said inner shroud projecting in a second, axial direction, diametrically opposite said first axial direction; said leading and trailing hooks of each said inner shroud being respectively engaged with said leading and trailing hooks of said outer shroud, said engagement axially and radially locking said inner shroud to said outer shroud.

The invention may also be embodied in a stator shroud of a multi-stage gas turbine comprising: a shroud segment having a surface for, in part, defining the hot gas path through one stage and overlaying tips of buckets of said one stage forming part of a turbine rotor, said shroud segment having a leading, upstream edge and a trailing, downstream edge; said shroud segment comprising an outer shroud and at least one inner shroud connected thereto; said outer shroud having a groove defined adjacent and along each of said leading and trailing edges thereof, said grooves opening axially in a same direction; and said inner shroud having a leading edge axially projecting tab portion and a trailing edge axially projecting tab portion for respectively engaging said grooves of said outer shroud, said engagement axially and radially locking said inner shroud to said outer shroud The invention may further be embodied in a method of disengaging and removing a first inner shroud having a leading edge hook and a trailing edge hook from an outer shroud having a leading edge groove and a trailing edge groove mutually engaged with said leading and trailing edge hooks of said first inner shroud, said leading and trailing edge hooks of said first inner shroud projecting in a same axial direction, said method comprising: one of removing and axially displacing a mating part on an upstream side of said first inner shroud; removing a first inner shroud anti-rotation pin engaging said first inner shroud and said outer shroud; removing anti-rotation pins from circumferentially adjacent inner shrouds and sliding said circumferentially adjacent inner shrouds until clear of cloth seals therebetween; sliding said first inner shroud axially to disengage the leading and trailing edge hooks from said leading and trailing edge hooks of said outer shroud; and displacing said first shroud radially to disengage and remove said first inner shroud.

BRIEF DESCRIPTION OF THE DRAWINGS

These and other objects and advantages of this invention, will be more completely understood and appreciated by careful study of the following more detailed description of the presently preferred exemplary embodiments of the invention taken in conjunction with the accompanying drawings, in which.

DETAILED DESCRIPTION OF THE INVENTION

Figure 1:
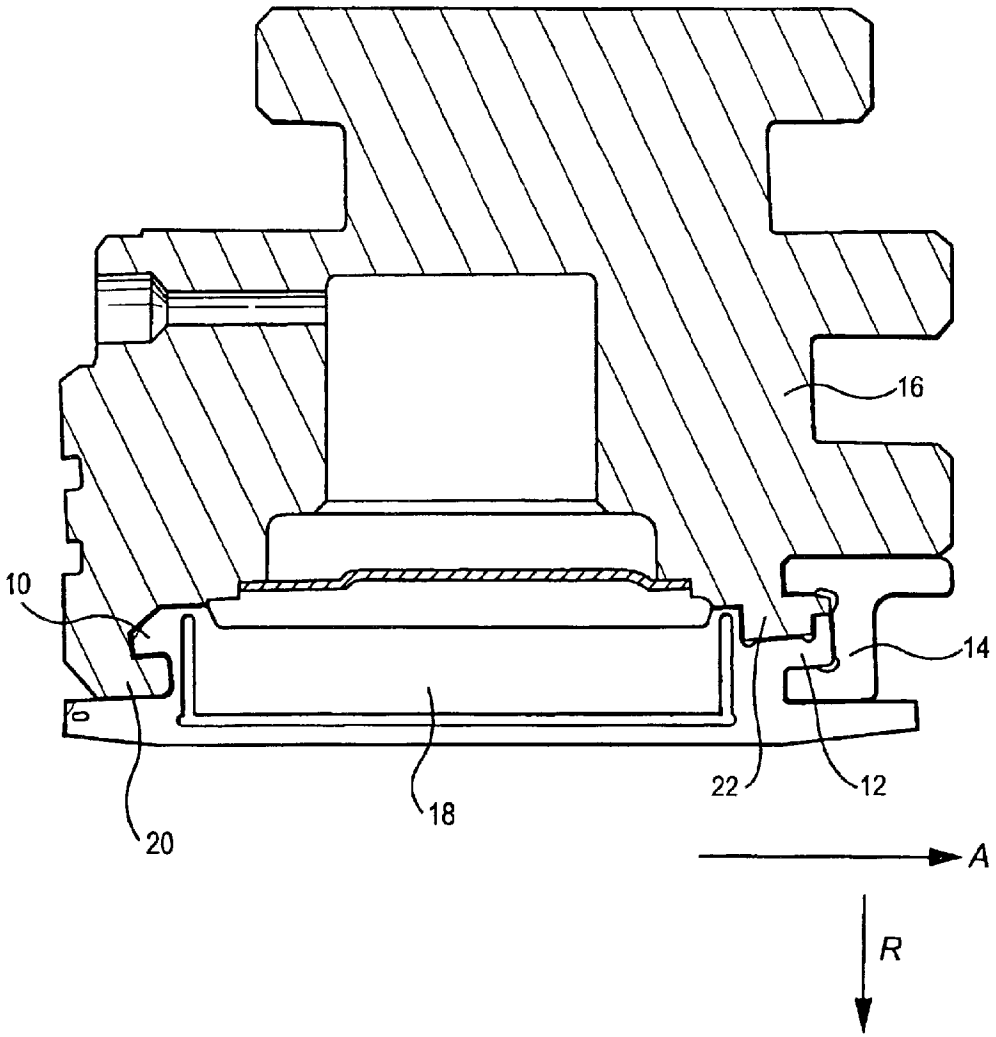
Fig. 1 (Prior Art)
FIG. 1 is a schematic shroud segment circumferential end views, partly broken away, showing a conventional C-clip inner shroud retention design.

As mentioned above, FIG. 1 schematically illustrates a conventional C-clip design. As shown, the inner shroud 18 includes an inner shroud leading or upstream edge inner shroud hook 10 and an inner shroud trailing or downstream edge hook 12 for engagement with corresponding leading and trailing edge hooks 20, 22 of the outer shroud 16. The inner shroud trailing edge hook 12 is secured to the trailing edge hook 22 of the outer shroud 16 with a separate C-clip 14, rather than being maintained by the outer shroud structure. To remove the inner shroud, the C-clip 14 must be removed, the inner shroud 18 is moved radially (Arrow R) or, more specifically, rotated about the leading edge hook 10 until the trailing edge of the inner shroud clears the outer shroud 16, and then the inner shroud 18 is shifted axially (Arrow A) until fully clear of the outer shroud 16. As noted above, in addition to the added complexity of the additional C-clip components and features, the C-clip arrangement requires that the stage two nozzles in the area of interest be shifted circumferentially, which requires removal of the nozzle anti-rotation pins, to allow service access to the C-clip pin (not shown).

Referring to FIGS. 2–5, there is illustrated a shroud segment, generally designated 100, comprised of an outer shroud 116 and a plurality of inner shrouds 118. Typically two or three inner shrouds are provided. The illustrated shroud segment 100 is adapted to include three inner shrouds 118, only one of which is shown for clarity. As described in greater detail below, the inner shrouds have hooks 110 and 112 adjacent their leading and trailing edges, respectively, for circumferentially slidable engagement in grooves 126 and 128 defined by hooks 120,122 of the outer shroud 116 in final assembly. In the illustrated embodiment, an impingement cooling plate 124 is mounted between the shrouds for impingement cooling of the inner wall surfaces of the shroud segment 100, in a conventional manner.

Figure 2:
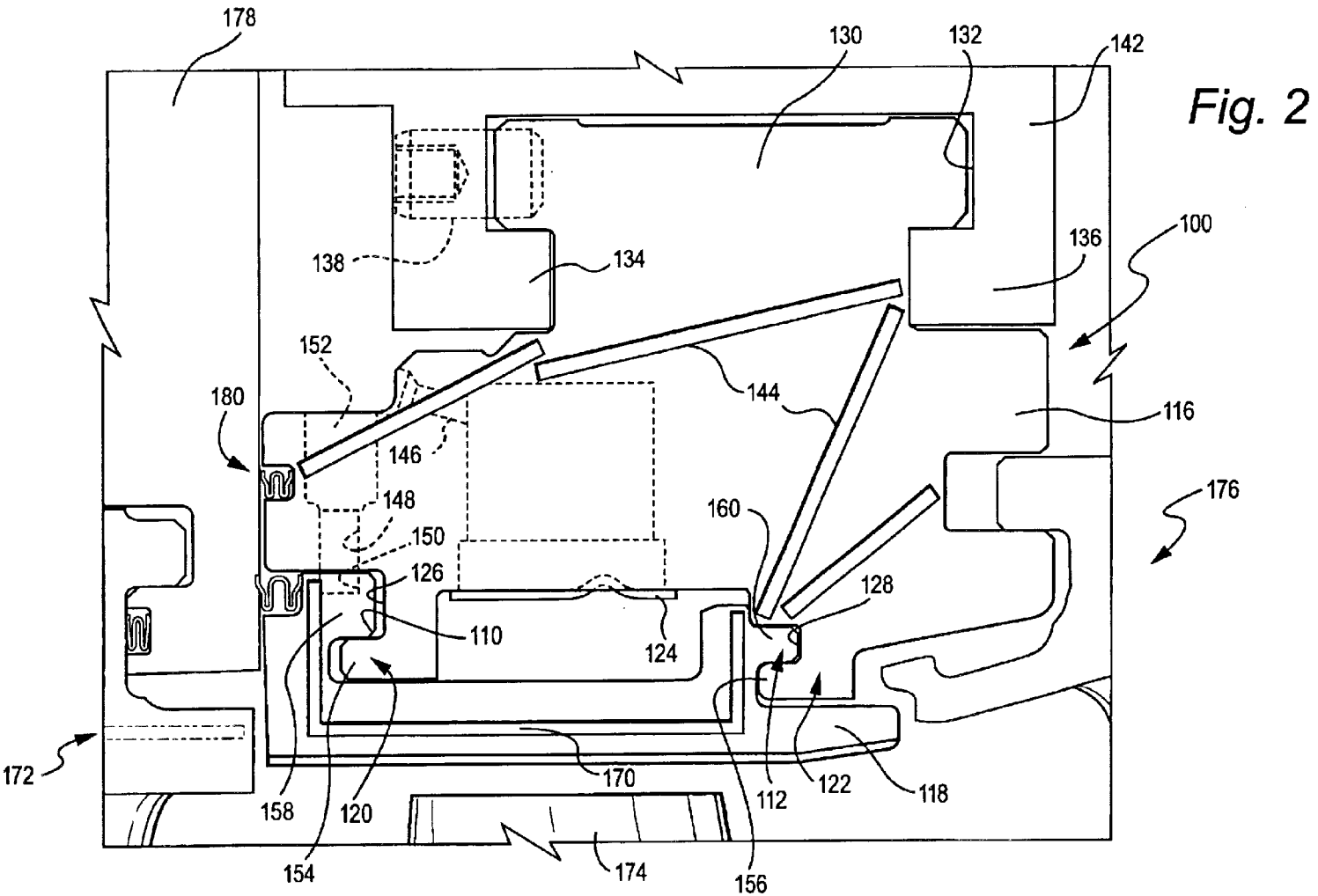
FIG. 2 is a schematic circumferential end view of a shroud segment embodying the invention.
Figure 4:
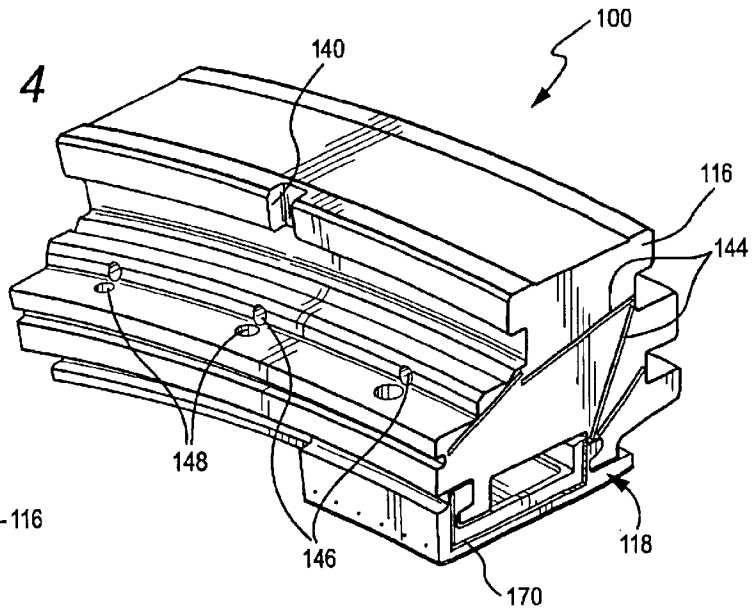
FIG. 4 is a perspective view from above of the assembly shown in FIG. 3.
Figure 3:
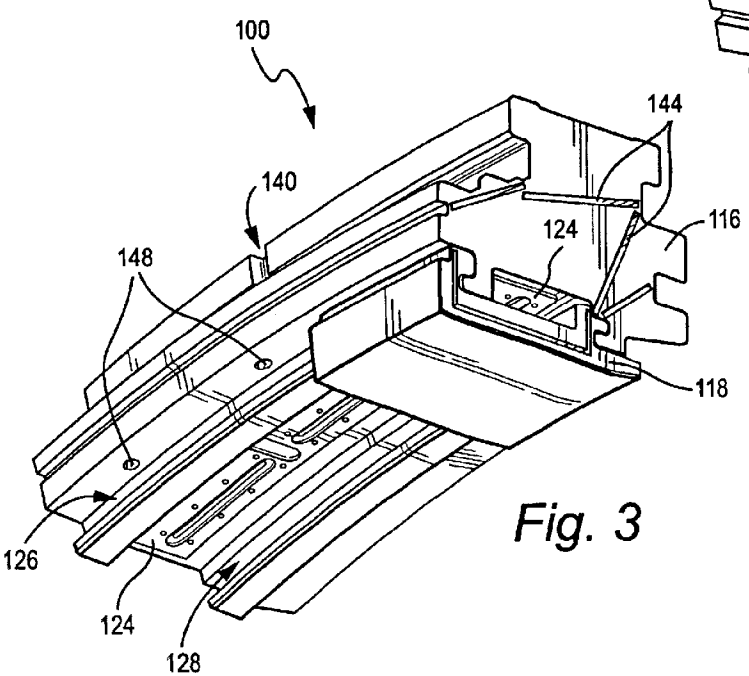
FIG. 3 is a perspective view of the shroud segment of FIG. 2 with two of the inner shroud segments omitted to reveal the radially inner configuration of the outer shroud.
Figure 5:
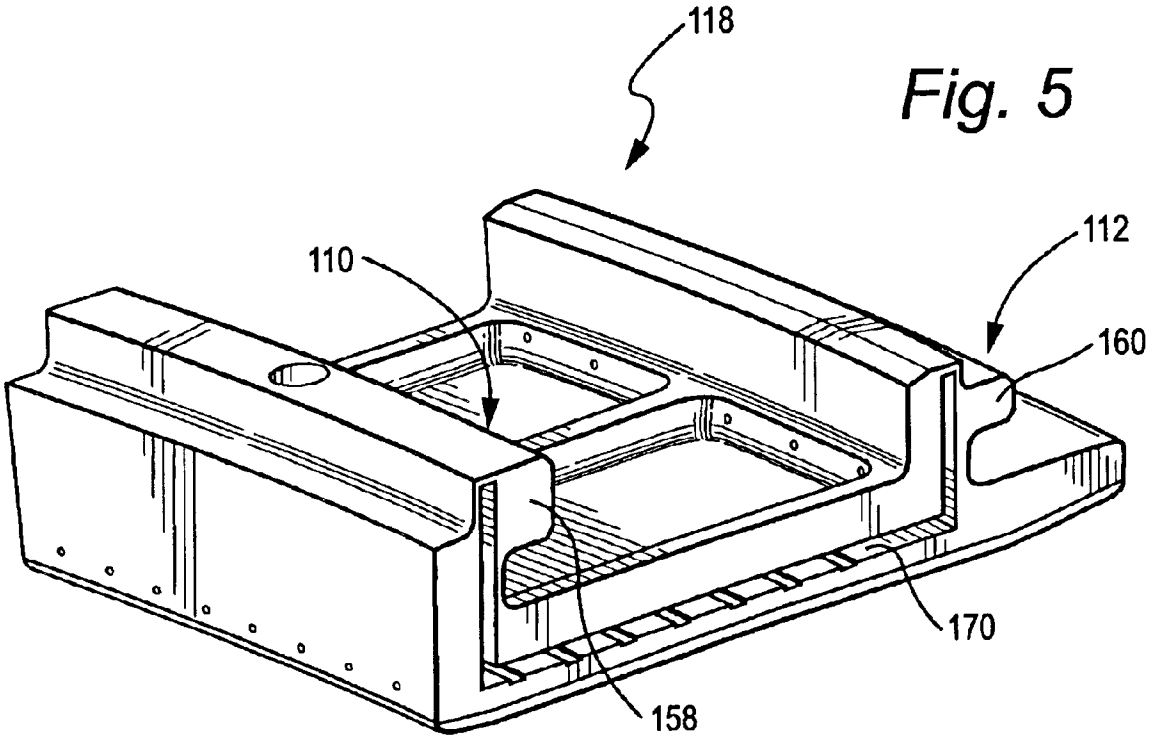
FIG. 5 is a perspective view of an inner shroud according to an embodiment of the invention.

In the illustrated embodiment, the outer shroud 116 has a radially outer dovetail 130 for engagement in a dovetail groove 132 defined by leading and trailing hooks 134,136 forming part of the fixed turbine shell or casing for securing the shroud segment to the casing. It is to be understood that as an alternative to the configuration illustrated, the outer shroud may be provided with a radially outer dovetail groove for receiving a correspondingly shaped dovetail formed as a part of the turbine casing. It will be appreciated that an annular array of shroud segments 100 are formed about the rotor of the gas turbine and about the tips of the buckets on the rotor, thereby defining an outer wall or boundary for the hot gas flowing through the hot gas path of the turbine. In FIG. 2, the inner shroud seal slots 170, the stage one nozzle structure 172, stage one bucket 174 and stage two nozzle structure 176 are shown for completeness and reference.

As mentioned above, as an embodiment of the invention, a reverse hook shroud configuration is provided to engage and hold the inner shrouds 118 to the outer shroud 116, to enhance service and assembly. With reference to FIG. 2, which is a detailed circumferential end view of a shroud segment 100 showing mating parts, it can be seen that the outer shroud 116 is engaged by leading and trailing casing hooks 134,136, as described above, and an outer shroud anti-rotation pin 138 is provided to extend into a corresponding slot 140 (FIG. 4) to circumferentially lock the outer shroud 116 with respect to the casing 142. In the illustrated embodiment, outer shroud seal slots 144 are shown as are air metering holes 146 and impingement plate 124. At the leading edge of the outer shroud, inner shroud anti-rotation pin bores 148 are further provided to align with corresponding holes 150 and to receive inner shroud anti-rotation pins 152.

In contrast to the conventional configuration described above and illustrated in FIG. 1, the leading edge hook 120 of the outer shroud 116 is reversed so as to include a tab portion 154 projecting axially upstream, away from the trailing edge. The trailing edge hook 122 of the outer shroud 116 also includes a tab portion 156 that projects axially upstream, toward the leading edge, in the same direction as the tab portion 154 of the leading edge hook 120. Thus, the grooves 126 and 128 of the outer shroud 116 both open axially in the upstream direction.

The hooks 110 and 112 of the inner shroud 118 are engaged with the leading and trailing edge hooks 120, 122, and in particular with the grooves 126, 128 of the outer shroud 116. More particularly, in the illustrated embodiment, the leading edge hook 110 of the inner shroud comprises a tab portion 158 that projects axially downstream, towards the trailing edge, so as to axially and radially engage the hook 120 of the outer shroud 116, to axially and radially lock the outer and inner shrouds. It should be noted that the stage one retaining ring, i.e., stage one nozzle hardware, contributes to locking the inner shroud as well. That is, the retaining ring prevents the shroud from shifting far enough forward to clear the leading edge hook of the outer shroud. Furthermore, in the illustrated embodiment, as mentioned above, a receptacle or hole 150 is defined in the leading edge hook of the inner shroud for receiving the inner shroud anti-rotation pin 152 inserted through the corresponding bore 148 defined in the outer shroud leading edge portion.

The trailing edge hook of the inner shroud similarly includes a tab portion 160 extending axially downsteam, towards the trailing edge, in the same direction as the leading edge tab portion 158 to axially and radially lock with the trailing edge hook 122 of the outer shroud.

To remove an inner shroud of interest, first the retaining ring 178 (mating part) is removed or slid forward or in an upstream direction approximately 1 inch. Then the inner shroud leading edge W seal 180 is removed and the inner shroud anti-rotation pin 152 is backed out. Then, the anti-rotation pine of at least one adjacent inner shroud on each side are removed and those inner shrouds are slid circumferentially until clear of cloth seals. The target inner shroud is then removed by sliding axially to disengage the leading and trailing edge hooks 110,112 and then radially. A new inner shroud is then installed by inserting radially and then sliding axially, repositioning the adjacent inner shrouds to engage cloth seals and reinstalling the inner shroud anti-rotation pins.

Compared to the C-clip design, the reverse hook configuration eliminates the need to remove the C-clip and stage two nozzle anti-rotation pins. That is, in the C-clip design, one must slide enough stage two nozzles circumferentially until the C-clip retention pin is accessible. This requires removing all proceeding stage two nozzle anti-rotation pins. These steps are all eliminated with the reverse hook design of the illustrated embodiment.

The illustrated shroud assembly achieves axial installation and removal by reversing the leading edge hook 110 as compared to the traditional and C-clip designs. From the standpoint of service and assembly, the ability to remove the inner shroud axially can eliminate or reduce service steps including removal of mating outer shrouds, C-clips and stage two nozzle anti-rotation pins. This arrangement also simplifies producibility by reducing the number of machined features required as compared to the C-clip design while achieving the same service enhancement objectives.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A stator shroud of a multi-stage gas turbine comprising:

a shroud segment having a surface for, in part, defining a hot gas path through one stage and overlaying tips of buckets of said one stage forming part of a turbine rotor, said shroud segment having a leading, upstream edge and a trailing, downstream edge;

said shroud segment comprising an outer shroud and at least one inner shroud connected thereto;

said outer shroud having a groove defined adjacent and along each of said leading and trailing edges thereof, said grooves opening axially in a same direction;

said inner shroud having a leading edge axially projecting tab portion and a trailing edge axially projecting tab portion for respectively engaging said grooves of said outer shroud, said engagement axially and radially locking said inner shroud to said outer shroud; and an anti-rotation pin extending through a bore defined in said outer shroud into a corresponding receptacle defined in said inner shroud to circumferentially lock said inner shroud to said outer shroud, said bore being defined through the outer shroud so that the pin is accessible for removal from the outer shroud when the inner shroud is radially locked to said outer shroud.

2. A stator shroud as in claim 1, wherein said grooves open in an axially upstream direction.

3. A stator shroud as in claim 1, comprising three said inner shrouds secured to said outer shroud.

4. A stator shroud as in claim 1, further comprising a coolant cavity defined by inner wall surfaces of said inner and outer shrouds, and an impingement plate disposed between said inner and outer shrouds for impingement cooling said inner wall surfaces of said inner shroud.

5. A stator shroud as in claim 1, wherein a radially outer portion of said outer shroud has a dovetail configuration for engaging a corresponding dovetail groove configuration of an adjacent turbine casing.

6. A stator shroud segment comprising:

an outer shroud having a leading, upstream edge and a trailing, downstream edge, and radially inner and radially outer faces, said outer shroud comprising a leading edge hook and a trailing edge hook, both said hooks of said outer shroud projecting in a first, axial direction;

a plurality of inner shrouds each having a leading, upstream edge and a trailing, downstream edge, and radially inner and radially outer faces, said inner shroud comprising a leading edge hook and a trailing edge hook, both said hooks of said inner shroud projecting in a second, axial direction, diametrically opposite said first axial direction;

said leading and trailing hooks of each said inner shroud being respectively engaged with said leading and trailing hooks of said outer shroud, said engagement axially and radially locking said inner shroud to said outer shroud; and an anti-rotation pin extending through a bore defined in said leading edge hook of said outer shroud into a corresponding receptacle defined in said leading edge hook of said inner shroud to circumferentially lock said inner shroud with respect to said outer shroud, said bore being defined through the outer shroud so that the pin is accessible for removal from the outer shroud when the inner shroud is radially locked to said outer shroud.

7. A stator shroud segment as in claim 6, wherein said first axial direction is an upstream direction.

8. A stator shroud segment as in claim 6, comprising three said inner shrouds secured to said outer shroud.

9. A stator shroud segment as in claim 6, further comprising a coolant cavity defined between said radially inner face of said outer shroud and said radially outer face of said inner shroud, and an impingement plate disposed between said inner and outer shrouds for impingement cooling said radially outer face of said inner shroud.

10. A stator shroud segment as in claim 6, wherein a radially outer portion of said outer shroud has a dovetail configuration for engaging a corresponding dovetail groove configuration of an adjacent turbine casing.

11. A stator shroud segment as in claim 6, wherein said leading and trailing edge hooks of said outer shroud define respective leading and trailing edge grooves that open in said first direction for respectively receiving therein said leading and trailing edge hooks of said inner shrouds.

12. A method for disengaging and removing a first inner shroud having a leading edge hook and a trailing edge hook from an outer shroud having a leading edge groove and a trailing edge groove mutually engaged with said leading and trailing edge hooks of said first inner shroud, said leading and trailing edge hooks of said first inner shroud projecting in a same axial direction, said method comprising:

one of removing and axially displacing a mating part on an upstream side of said first inner shroud;

removing a first inner shroud anti-rotation pin engaging said first inner shroud and said outer shroud;

removing anti-rotation pins from circumferentially adjacent inner shrouds and sliding said circumferentially adjacent inner shrouds until clear of cloth seals therebetween;

sliding said first inner shroud axially to disengage the leading and trailing edge hooks from said leading and trailing edge hooks of said outer shroud; and displacing said first shroud radially to disengage and remove said first inner shroud.

13. A method as in claim 12, wherein said hooks of said first inner shroud project axially in a downstream direction and wherein said step of sliding said first inner shroud axially comprises sliding said first inner shroud in an upstream direction.

14. A stator shroud as in claim 1, wherein said bore is defined through the outer shroud so that the pin is accessible for removal from upstream of the outer shroud.

15. A stator shroud as in claim 6, wherein said bore is defined through the outer shroud so that the pin is accessible for removal from upstream of the outer shroud.

* * * * *

UNITED STATES PATENT AND TRADEMARK OFFICE

CERTIFICATE OF CORRECTION

PATENT NO. : 6,814,538 B2
DATED : November 9, 2004
INVENTOR(S) : Thompson

It is certified that error appears in the above-identified patent and that said Letters Patent is hereby corrected as shown below:

Column 4,
Line 48, "pine" should be -- pins --.

Signed and Sealed this

Twenty-ninth Day of March, 2005

JON W. DUDAS
*Director of the United States Patent and Trademark Office*